United States Patent [19]
Thompson
[11] 4,318,291
[45] Mar. 9, 1982

[54] TUBE END FORMING APPARATUS

[75] Inventor: Alfred J. Thompson, Birmingham, England

[73] Assignee: Stevens & Bullivant Limited, Birmingham, England

[21] Appl. No.: 155,516

[22] Filed: Jun. 2, 1980

[30] Foreign Application Priority Data

Jun. 8, 1979 [GB] United Kingdom ..... 20051/79

[51] Int. Cl.³ ..... B21D 41/04
[52] U.S. Cl. ..... 72/306; 72/317
[58] Field of Search ..... 72/125, 306, 316, 317, 72/318, 422

[56] References Cited

U.S. PATENT DOCUMENTS

| | | | |
|---|---|---|---|
| 1,683,661 | 9/1928 | Felding | 72/306 |
| 1,962,944 | 6/1934 | Spatta | 72/306 |
| 2,442,224 | 5/1948 | Vaill | 72/306 |
| 3,059,686 | 10/1962 | Franck | 72/317 |
| 4,027,518 | 6/1977 | Ribback | 72/306 |

FOREIGN PATENT DOCUMENTS

| | | | |
|---|---|---|---|
| 2752905 | 5/1979 | Fed. Rep. of Germany | 72/306 |

*Primary Examiner*—Lowell A. Larson
*Attorney, Agent, or Firm*—C. O. Marshall, Jr.

[57] ABSTRACT

A tube or rod end forming apparatus comprises a rotary head (12) provided with a series of angularly spaced dies (30) for cooperation with a tube or rod held by a clamping device (10) which locates the tube or rod in alignment with the lowermost die (30). The head (12) is angularly indexable by means of an arm (50) which is pivotal about the rotary axis of the head (12) and is provided with a piston and cylinder operated plunger (52) for cooperation with sockets (56) in the head (12). The arm (50) is pivoted by a piston and cylinder (58) to effect indexing of the head (12). This arrangement allows accurate indexing of the head while positively holding it captive against rotation while the head executes a forming operation. The clamping device is so constructed that its jaws (70, 72) can be readily replaced or re-orientated for use with different tube diameters without the need for any bolting or like fastening devices. The apparatus can be automatically controlled to execute a series of working strokes whose lengths vary according to the die size, the head being returned to a predetermined datum position on completion of the working cycle.

9 Claims, 13 Drawing Figures

TUBE END FORMING APPARATUS

This invention relates to apparatus for forming the end of a tube, bar, rod or the like in preparation for example for drawing the tube or the like. For convenience the term "tube" will be used hereinafter generically to mean tube, bar, rod and the like.

Apparatus for tube end forming has, in the past, generally been of the rotary swaging type. However, in recent times, rotary swaging apparatus is tending to become less acceptable owing to the level of noise produced in operation. To meet the demand for lower noise levels, apparatus has been developed wherein tube end forming is accomplished by gripping the tube rigidly and advancing a number of female guides over the tube end in succession, each guide being smaller than the previous one so that the end of the tube is progressively tapered to point-like form.

British Pat. No. 1266951 discloses one form of this apparatus wherein the dies are mounted in a rotary head. In the practical form of this apparatus, rotary indexing of the head has been effected by means of a rotary motor coupled to the head via a gear train. This indexing mechanism however has not been entirely satisfactory in that backlash in the gearing permits some degree of rotational play in the position of the rotary head and on occasions the gear teeth have been damaged for example due to inaccurate alignment between the tube and the die which can result in stressing of the gear teeth as the die is forced over the tube.

The object of the present invention is to provide improved apparatus of this type.

According to the invention we provide tube end forming apparatus comprising a clamping device for rigidly holding a tube against longitudinal movement, a rotary head mounted for reciprocation lengthwise of the longitudinal axis of the tube when held by the clamping device, the axis of rotation of the rotary head being offset relative to said longitudinal axis, the rotary head being provided with a plurality of die-mounting openings spaced angularly about said rotation axis, means for indexing the rotary head about said rotation axis to bring respective ones of said openings into alignment with said longitudinal axis, means for reciprocating the rotary head whereby, in use, on one stroke of the head a die is forced over the end of a tube held by the clamping device, characterised in that the indexing means comprises an arm which is movable angularly about the rotational axis of said head and is provided with a plunger engageable with a plurality of sockets, one at a time, provided in the rotary head and means for pivoting said arm to-and-fro through predetermined angular increments corresponding to the spacing between said sockets.

In the preferred embodiments of the invention, said arm pivoting means comprises a fluid powered piston and cylinder device connected to said arm and extendable and retractable in a plane substantially perpendicular to said rotational axis of the head, said piston and cylinder device being mounted on a carriage which also carries said arm and said head and which is connected to said reciprocating means. A second plunger may be provided to engage with said sockets, the first mentioned plunger and said second plunger being operable alternately whereby the head is engaged by said second plunger while said arm is being pivoted with the first plunger out of engagement with said sockets.

The preferred embodiment of the invention includes means for automatically controlling the axial and rotational positioning of the rotary head, said control means including means for sensing the axial and rotational positions of the rotary head and being automatically operable to bring the rotary head into a predetermined axial datum position relative to the clamping device in preparation for each working cycle.

Preferably the control means is operable in a manual mode as well as an automatic mode to enable the operator to control the apparatus to select which dies are employed and determine various stroke lengths for each die, the control means being arranged to register the die selected and such manually controlled stroke lengths and thereafter repeat the work cycle automatically using the selected dies and the manually determined stroke lengths. Thus, with the apparatus in accordance with the invention, the operator may initially manually control the apparatus for the first of a series of like tubes and once the required die sizes and stroke lengths have been selected, the ends of the remaining tubes may be formed automatically, it being necessary only for the operator to clamp and unclamp the tubes. Before clamping each tube, the operator may bring the tube into a predetermined axial position by advancing the tube until it abuts the die located at the working station, the rotary head having been brought into said datum position at the end of the preceding working cycle.

The die mounting openings preferably all have the same cross-sectional dimensions and receive female dies which have differing internal dimensions but the same external dimensions, each die being adapted to be engaged in pockets whose outer periphery corresponds to said openings, the rotary head being provided with abutments which partly overlie said openings and the die pockets being formed with flanges such that the die pockets can be introduced into said openings when oriented in one angular position but when oriented in a second angular position after insertion into said openings, they are held captive in said openings by engagement between said flanges and said bosses.

According to a feature of the invention the clamping device comprises a pair of jaw blocks removably located within a housing, one of the jaw blocks being stationary and the other being slidable towards and away from said one block under the control of a fluid-powered ram or rams so as to clamp or unclamp a tube therebetween. Said jaws are preferably connected at opposite axial ends thereof one to a stationary part of the housing and the other to a movable part and the housing is provided with an opening at one end through which the jaws are accessible, the jaw ends adjacent said opening being connected to said stationary part and said movable part by respective connecting elements which are held in place solely by removable plates inserted into the housing at said one end thereof whereby removal of said plates allows said connecting elements to be removed and the jaws to be withdrawn endwise through said opening. The opposite ends of the jaws will likewise be connected to said stationary part and movable part by connecting elements which prevent lateral movement of the jaws relative to the stationary and movable parts respectively but not axial movement, the latter being prevented by the connecting elements provided in the vicinity of said opening of the housing.

In one embodiment, each jaw is of polygonal section having in each face thereof a part-cylindrical recess for co-operation with a similar recess of an opposed face of the other jaw, the recesses in each jaw being of different dimensions whereby tubes of different diameter can be accommodated. In another embodiment, the jaws are each provided with a liner which is formed with a part-cylindrical recess, each liner being removable for interchange with liners having recesses of different dimensions. The liners conveniently have an outer periphery of part-cylindrical configuration and fit into a corresponding recess in each jaw, the liners and jaws having complementary dovetail formations along the part-circular ends thereof.

Various other features and advantages of the invention will become apparent from the following description of one preferred embodiment. In the drawings.

Figure 3A:
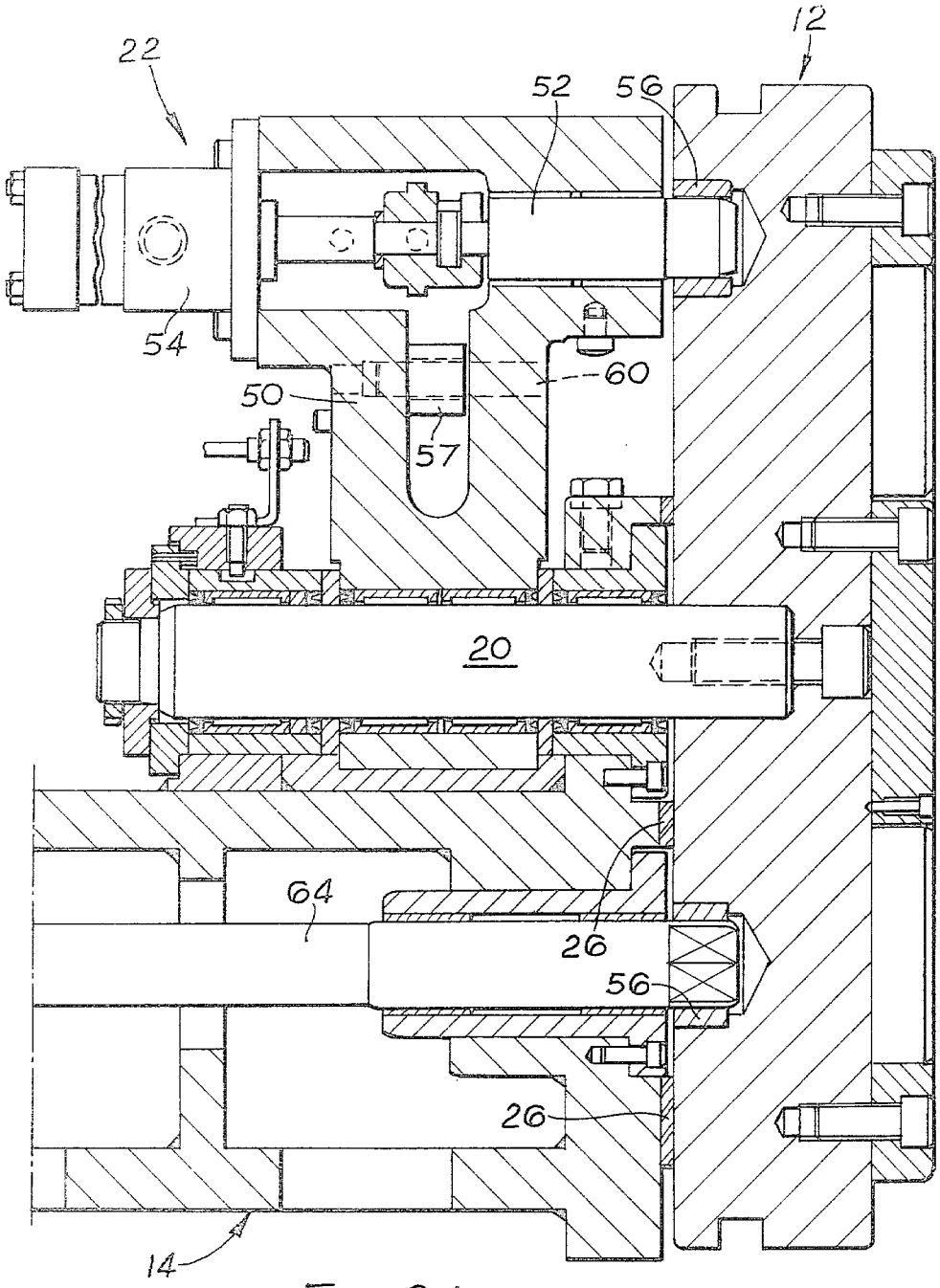
Figure 3B:
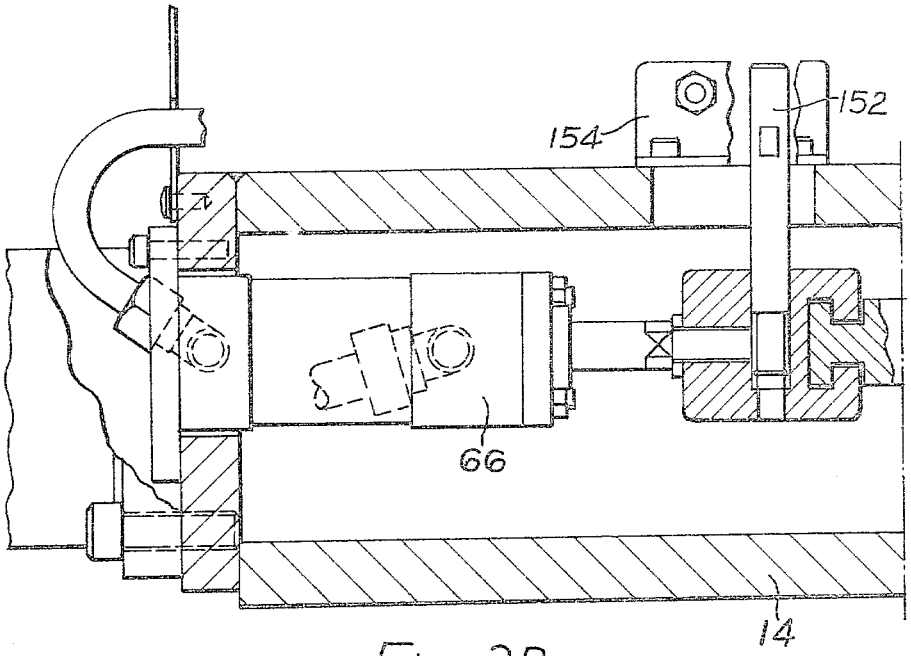
Figure 4:
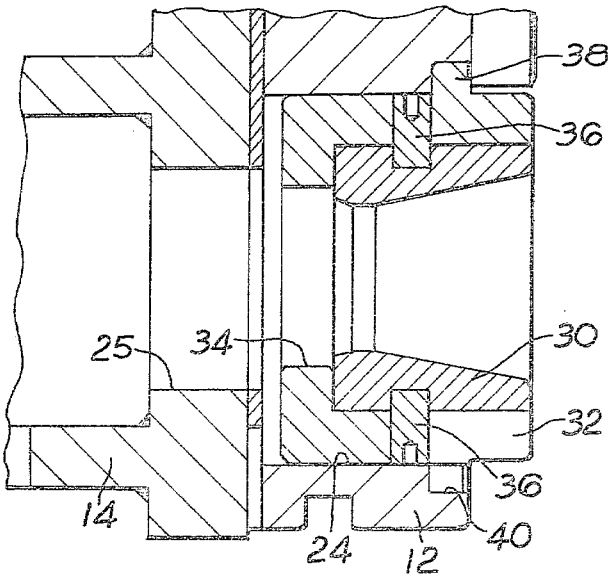
Figure 5:
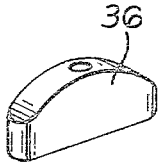
Figure 6:
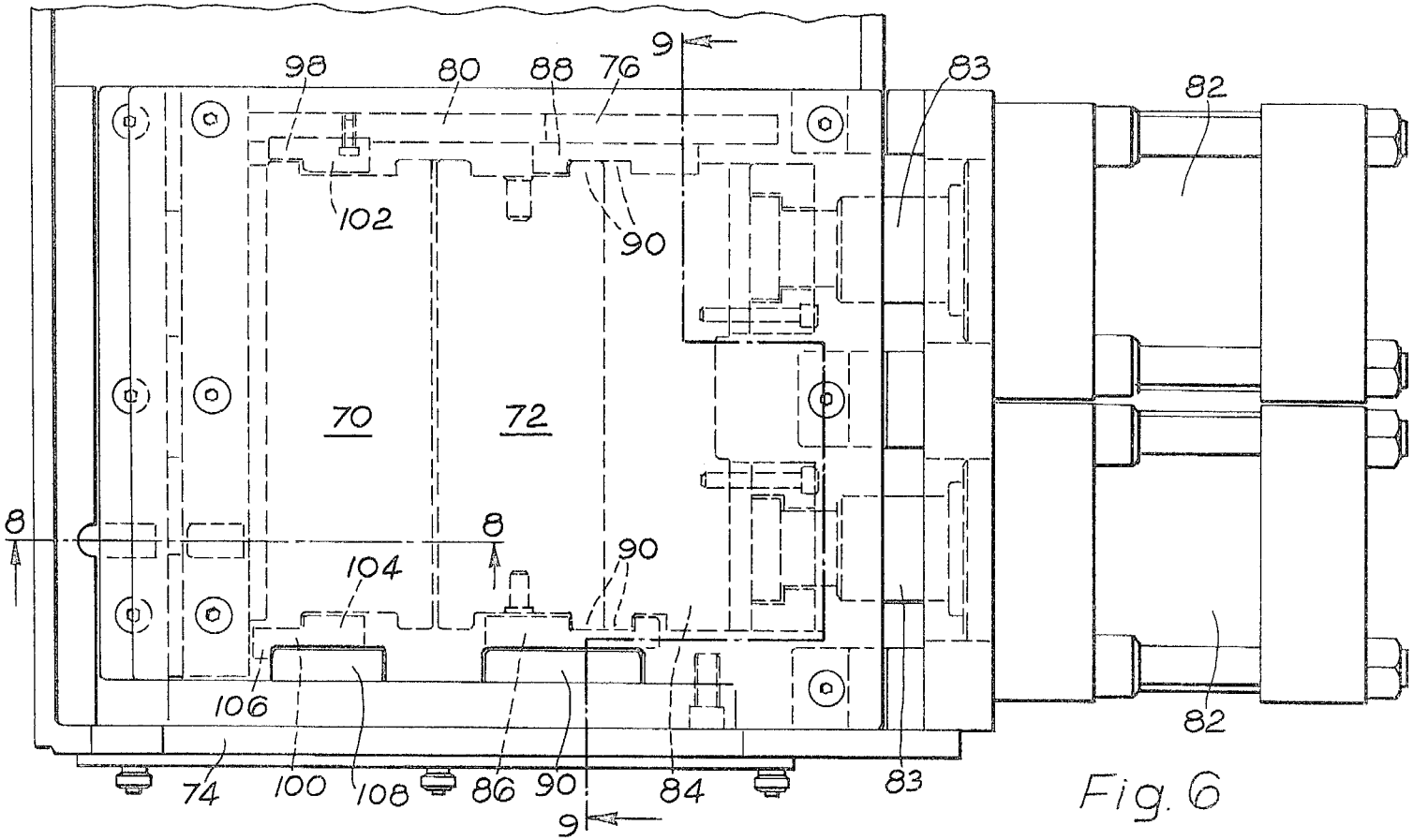
Figure 7:
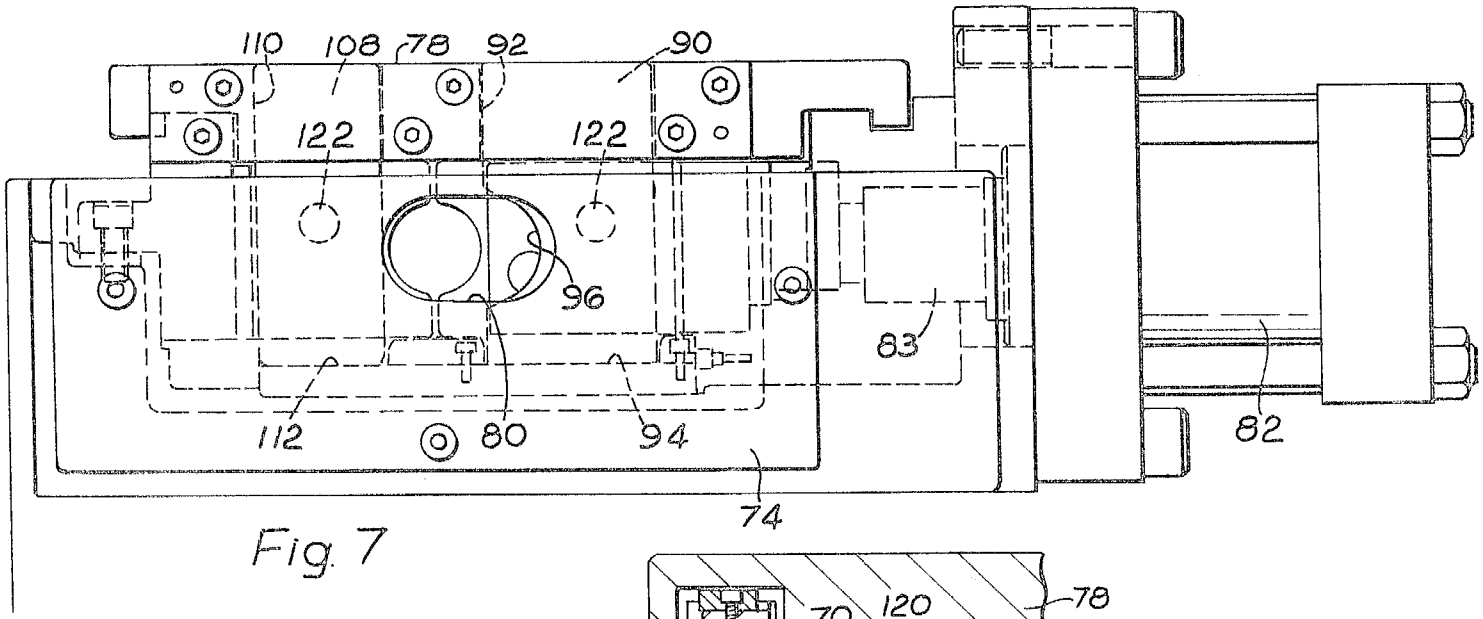
Figure 8:
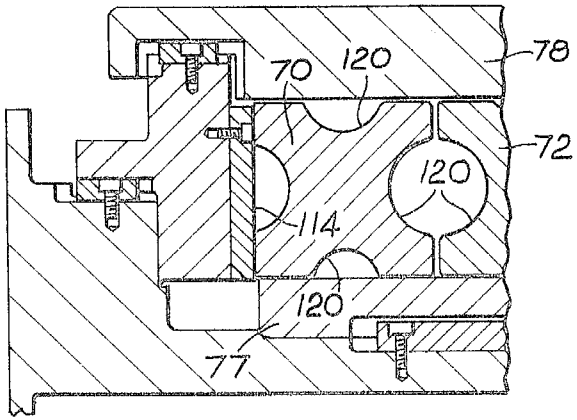
Figure 9:
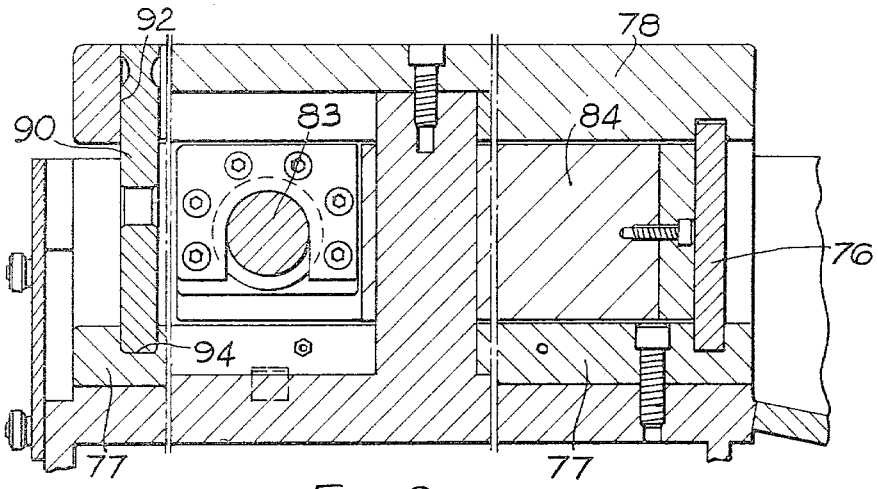
Figure 10:
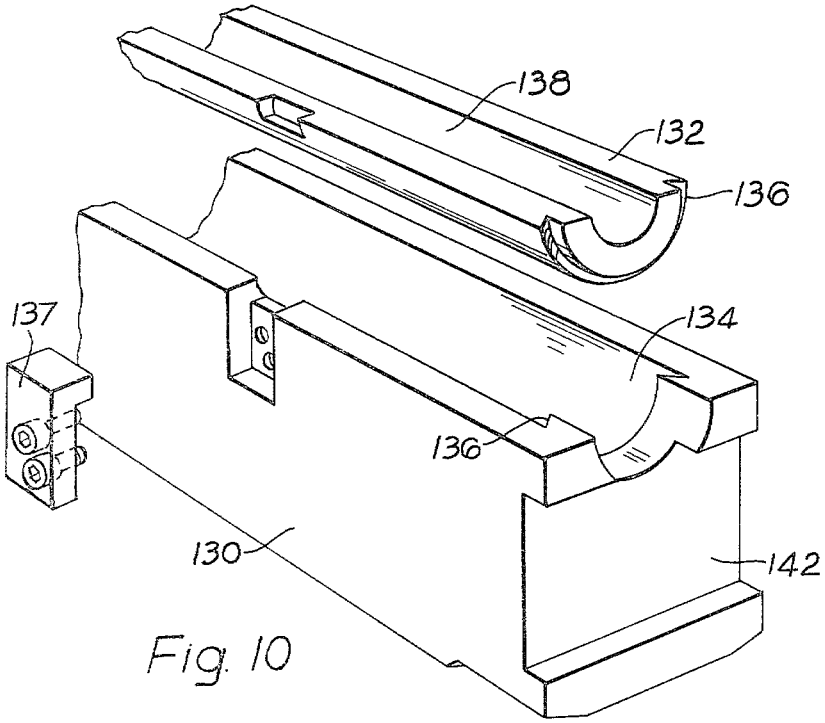
Figure 11:
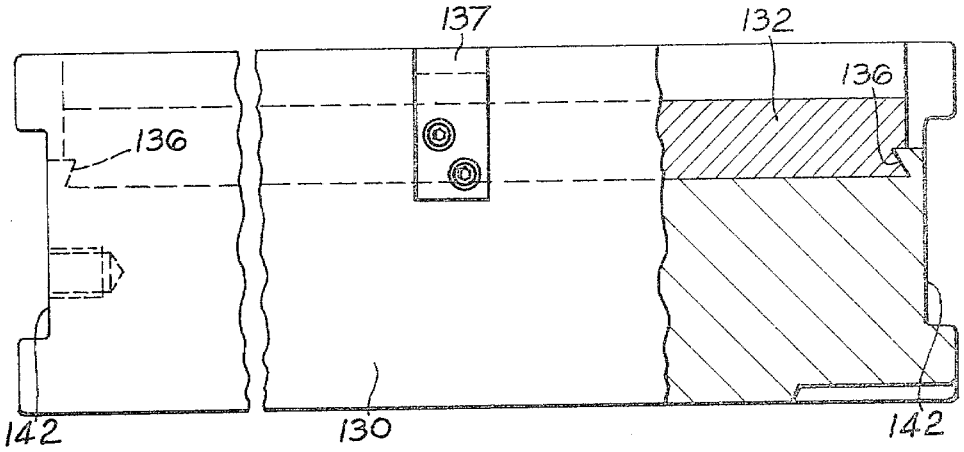
Figure 12:
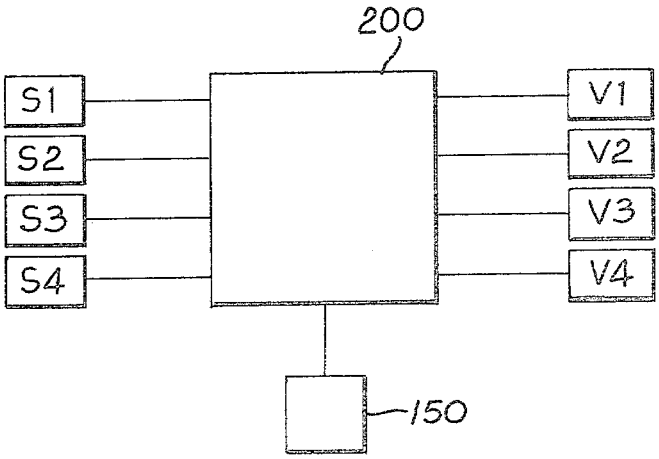

FIGS. 3A and 3B comprise an axial section through the die holder, carriage and indexing mechanism;

FIG. 4 is a an exploded sectional view showing the mounting of the dies in the die holder;

FIG. 5 is a view showing a key for use in holding the dies in place in the die pockets;

FIG. 6 is a plan elevation of the clamping device of the machine;

FIG. 7 is a front elevation of the clamping device;

FIG. 8 is a fragmentary sectional view taken in the direction 8—8 in FIG. 6;

FIG. 9 is a sectional view taken in the direction 9—9 in FIG. 6;

FIG. 10 is an exploded perspective view of the modified jaw lock for use in the clamping device of FIGS. 6 to 9;

FIG. 11 is a longitudinal section through the clamping block of FIG. 10; and FIG. 12 is a schematic diagram of the control circuitry of the apparatus.

Figure 2:
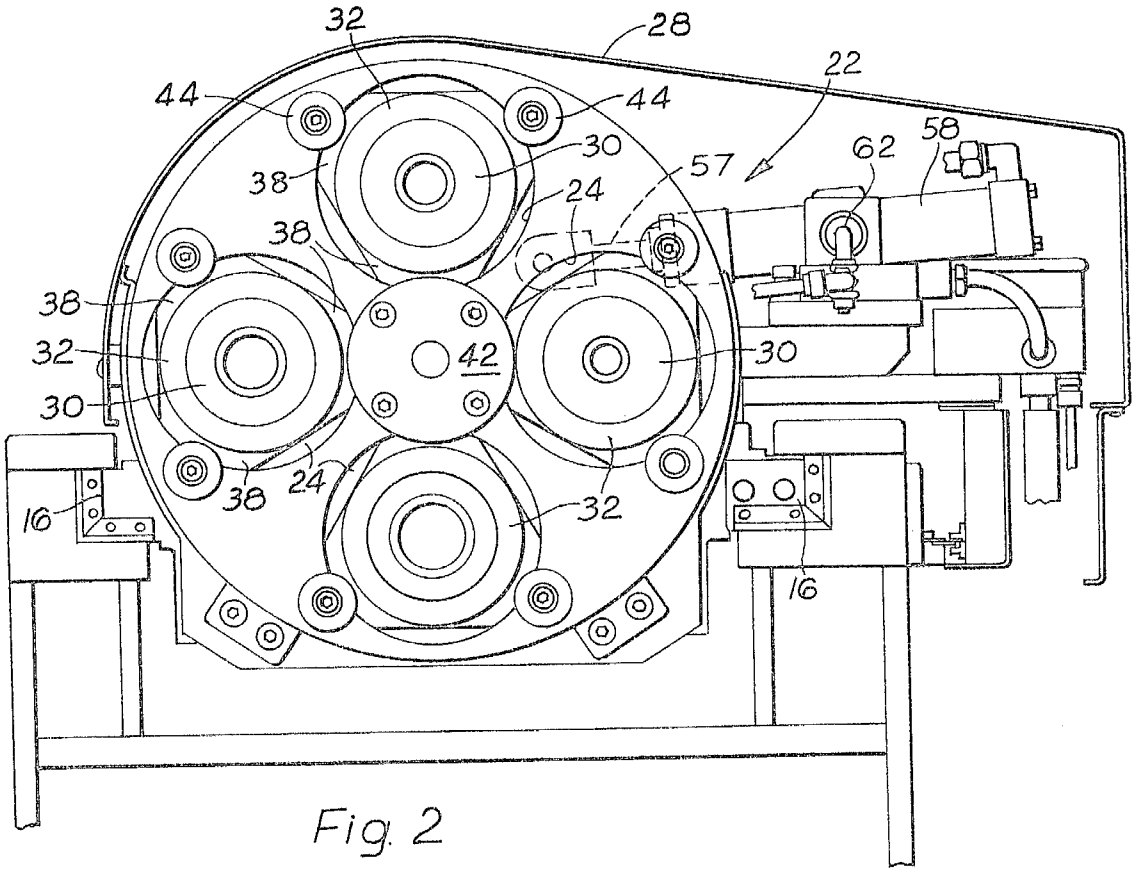
FIG. 2 is a view of part of the apparatus in the form of a front elevation of the die holder, carriage and indexing mechanism of the machine.

Referring now to the drawings, the push-pointing machine comprises a tube clamping device 10 and a rotary die holder 12 which is mounted on a carriage 14 (see FIGS. 2, 3A and 3B). The carriage 14 is mounted via slideways 16 for reciprocation towards and away from the clamping device 10 and a hydraulic ram 18 is provided for effecting such reciprocation. The die holder 12 is rotatably mounted on the carriage 14 via a shaft 20 and suitable bearings and is indexable about the shaft axis by an indexing mechanism 22 (see FIGS. 2 and 3A) which is also mounted on the carriage 14. The carriage 14 is provided with a hinged safety guard 28.

The die holder 12 is formed with a series of equi-angularly spaced die receiving cylindrical openings 24 (four are illustrated) whose axes are parallel to the shaft axis 20 and are spaced therefrom by radial distance substantially equal to the radial spacing between the shaft axis and the axis along which the ram 18 acts so that each opening 24 can, by means of the indexing mechanism 22, be brought into a position in which its axis is substantially co-axial with the ram 18.

The ram axis will also be co-axial with the axis of a tube held by the clamping device 10 provided that the clamping jaws of the latter have been selected according to the tube size as will be explained hereinafter. In FIGS. 2 and 4, the opening 24 which is lowermost is co-axial with the ram 18 and is in registry with an opening 25 in the carriage structure 14. If desired, the carriage 14 may be reciprocated by means of two rams instead of the single ram 18 and, in this event, the two rams would have their axes spaced equi-distantly from the axis of shaft 20 and lying in a plane which also contains the axis of the lowest opening 24, as seen in FIG. 4, and the axis of a tube clamped by the clamping device 10. It will be noted that the force applied to the die holder 12 by the ram 18 during the forward stroke of the carriage is transmitted through the carriage 14 via shims 26 (see FIG. 3A) and not via the shaft 20.

The openings 24 receive respective die and pocket assemblies of the novel type shown in FIG. 4. Each die 30 is of annular configuration and is received snugly in the respective cylindrical pocket 32 which has an aperture 34 in its base for registry with the opening 25 whereby, during operation, the dies can be advanced over the clamped tube without obstruction. One or more keys 36 are provided to key the die to the pocket as shown in FIGS. 4 and 5. The wall of the pocket 32 is formed with a part-annular slot for reception of the key 36 and the outer periphery of the die is recessed to receive the inner end of the key whose outer end conforms in curvature with outer periphery of the pocket 32. To retain each pocket/die assembly in position, each pocket 32 is formed with radial flanges 38 (see FIG. 2) which fit into the enlarged mouth 40 of each opening 24 and are so designed that the pockets can each be trapped within the openings 24 by a central boss 42 and a pair of bosses 44 in the manner indicated in FIG. 2.

To release a pocket/die assembly, the pocket is rotated until its flanges 38 are clear of the bosses 42, 44, thus enabling the assembly to be withdrawn axially from the respective opening 24. Each pocket will have the same outside diameter as the others and similarly for the dies but the inside diameters of the dies will vary according to the reduction to be effected thereby. From the foregoing, it will be seen that a particularly simple die replacement system is provided and moreover the dies are held securely within each opening without any risk of the dies being displaced radially during the tube end forming operations.

Referring to FIGS. 2, 3A and 3B, the indexing mechanism 22 comprises an arm 50 journalled on the shaft 20 and provided at its outer end with a plunger 52 which is displaceable parallel to the axis of the shaft 20 by a fluid-powered cylinder 54. The die holder 12 is provided on its rear face with a number of sockets 54, equally spaced about shaft 20 and equally numbered to the number of die receiving openings 24 (four are illustrated in the preferred embodiment). The plunger 52 can be extended to engage in each of the sockets 56, as shown in FIG. 3A, to couple the die holder 12 to the arm 50 which, in turn, is coupled by pin 60 to the piston 57 of a fluid-powered cylinder 58 pivoted at 62 to the carriage 14. Diametrically opposite the plunger 52, there is a second axially displaceable plunger 64 operable by a fluid-powered cylinder 66 (see FIG. 3B) for engagement with one of the sockets 56. Operation of the cylinders 54, 58 and 66 is so coordinated that the die holder 12 can be indexed, either way, through 90° increments and held in each position of indexing, as will be explained further below.

Referring to FIGS. 6 to 9, the clamping device comprises a pair of elongate jaw blocks 70, 72 located within the housing having, inter alia, end walls 74, 76, a base 77, and a top wall 78. The end walls 74, 76 are formed with aligned lozenge-shaped openings 80 whose major medial axes lie in the same plane as the axis of the ram 18. The jaws 70 and 72 are of regular polygonal cross-section and are arranged with their longitudinal axes parallel to the axis about which the die holder 12 rotates. The jaw 70 is held fixedly within the housing whilst the jaw 72 is movable towards and away from the jaw 70 under the control of a pair of hydraulic cylinders 82 whose pistons 83 are connected to a common cross-head 84.

The ends of the jaw 72 and the cross-head 84 are slotted and are coupled together by bridging plates 86, 88 which are slotted to receive projecting formations 90 of the jaw and cross-piece ends, see FIG. 6. The bridging plate 88 is held in place by face-wise sliding abutment with the end wall 76 and may be secured, if desired, to the cross-head 84 whilst the bridging plate 86 is held in place solely by face-wise sliding abutment with a plate 90 which is inserted into the housing through an opening 92 in the top wall 80 and engages in a recess 94 in the base 77. The plate 90 is cut away at 96 so that it does not unduly obstruct the opening 80 in end wall 74.

The ends of the jaw 70 are likewise slotted (jaws 70 and 72 will in general be of identical shape and size) and are fixedly held in place by retaining plates 98, 100, the former being secured to the end wall 76 and having a formation 102 engaging in the slotted end face of the jaw 70 and the latter being generally of Z-configuration as seen in plan having a first portion 104 engaged with the adjacent slotted jaw end face and a second portion 106 trapped by abutment with a plate 108 which like the plate 90 is inserted through an opening 110 in the top wall 78 so as to engage in a recess 112 in the base 77. In this way, the jaw 70 is held securely in place with one face thereof in abutment with side wall 114 of the housing.

In the embodiment illustrated in FIGS. 6 to 9, each jaw block 70, 72 is of generally square cross-section and each face is formed with a part-cylindrical recess 120 of different size to the remaining faces so that when the jaw blocks are located with corresponding faces opposed they may accommodate different sized tubes according to which faces are opposed. The blocks 70, 72 are so dimensioned that irrespective of which faces rest on the base 77, the axes of the opposed like recesses 120 are substantially co-planar with the axis of the ram 18 and hence the axis of the lowermost opening 24 of the die holder 12 when the latter is in the position shown in FIG. 2. Hence any tube clamped by the jaws 70, 72 is located with its axis in alignment with the die received by the lowermost opening 24. In this embodiment, wherein the blocks 70, 72 can be disposed with any of their side faces resting on the base 77, the end faces thereof will be formed with intersecting slots for cooperation with the plates 86, 88, 98 and 100.

A notable feature of the device described above is the rapidity with which the jaws 70, 72 can be removed and replaced, for example when a change in the tube size necessitates this. Thus to remove the jaws 70, 72 the end wall 74 is first removed and the plates 90 and 108 are then withdrawn upwardly. To facilitate withdrawal, the plates 90 and 108 may be formed with finger holes 122. Once plates 90 and 108 are withdrawn, the plates 86 and 100 and hence the jaws 70, 72 are freed and can be removed. The jaws can then be replaced in the new orientation and secured by replacing the plates 86 and 100 and re-inserting the plates 90 and 108.

FIGS. 10 and 11 show a modified jaw block 130, which can be used in place of the jaws 70 and 72. Instead of each face being recessed, the jaw 130 is provided with one of a range of liners 132. Each liner of the range is semi-cylindrical and is dimensioned to fit in a semi-cylindrical recess 134 in the jaw, the jaw and liner having dovetail-like formations 136 to enable the liner to be slid into place and securely held with the aid of a key 137. Each liner 132 associated with one jaw 130 has a different sized semi-cylindrical recess 138 so that different sized jaw openings can be obtained. As shown in FIGS. 10 and 11, the end faces of the jaw need only be provided with a single slot 142 in this embodiment.

A typical working cycle of the apparatus will now be described.

Assuming that the jaw opening is appropriate for the tube to be processed, initially the jaw 72 is retracted to allow the tube to be inserted fully through the housing of the clamping device so that sufficient length of the tube is exposed to the forming dies mounted in the die holder. The jaw 72 is next extended to clamp the tube between the jaws 70, 72. At this time, the die holder will be located in a retracted position and will be in an indexed position such that the die with the largest opening is located at the working position, i.e. in the lowermost position as shown in FIG. 2. Also, the plungers 52 and 64 will be engaged in sockets 56 to hold the die holder securely against any rotational movement. It will be noted that because the tubes co-operate with the lowermost die, any foreign matter can be washed away in this vicinity without entering the other dies.

The carriage 14 and die holder 12 are next advanced forwardly towards the clamping device 10 by the ram 18 either under manual control or under automatic control (as explained hereinafter) and the largest die is forced over the exposed end of the tube to reduce the diameter thereof. The carriage and die holder are then retracted until clear of the tube end (and hence rearwardly of said datum position) and the die holder is indexed, through 90° in the present case, to bring the next largest die into the working position.

To effect indexing, the plunger 52 is retracted by cylinder 54 clear of the socket 56, the piston 57 is retracted to swing the arm 50 through 90° so that the plunger 52 is brought into registry with the next socket 56, the plunger 52 is extended by cylinder 54 to engage in that socket, the plunger 64 is withdrawn from engagement with a corresponding socket and the cylinder 58 is operated to extend the piston 57 and swing the arm 50 through 90° whereupon the plunger 64 is brought into engagement with the socket now in alignment therewith. This procedure is repeated for each indexing operation and, in this way, counter-clockwise indexing of the die holder is effected (as viewed in FIG. 2). After the final die-forming stroke, the rotary head is retracted, indexed to bring the largest die back into the working position and then advanced to the datum position.

In some circumstances however a different sequence of indexing may be used, for example where the die holder is to be indexed from its current position to the position wherein the largest die is located at the working station and the clockwise angle between such positions is 90°. To reduce the indexing timing in such circumstances, clockwise indexing may be effected as follows. The plunger 64 is first retracted, the cylinder 58 is operated to swing the arm 50 through 90° thus indexing the die holder through the same angle because the latter is engaged by the plunger 52 and finally the plunger 64 is extended into engagement with the socket 56 now aligned therewith as a result of the indexing operation. It will be noted that in each indexed position, the die holder is held rigidly against rotation by the plungers 52 and 64.

Figure 1:
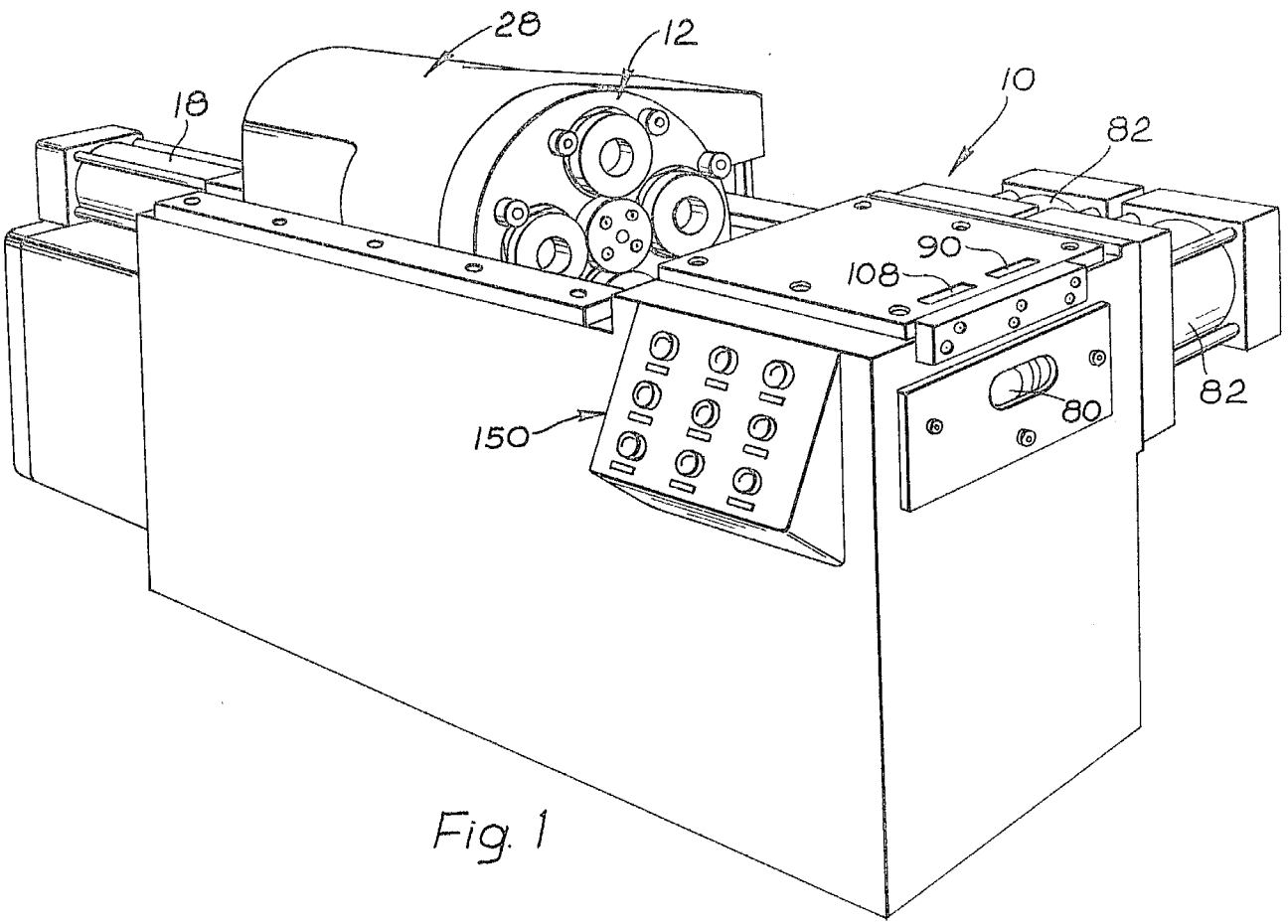
FIG. 1 is a diagrammatic perspective view of a push-pointing machine in accordance with the invention.

The machine is preferably micro-processor controlled and as shown in FIGS. 1 and 12, the machine includes an operator control console 150 which allows the operator to pre-program the machine to perform a desired sequence of operations on each of a series of tubes. Thus, the operator may manually control the machine for the first tube of the series in order to determine a suitable stroke length for each of the dies employed. Once the desired settings have been selected, these can be memorised by the micro-processor control circuitry 200 so that the operator need only insert and remove each tube to be formed.

The control circuitry 200 serves to control operation of for example electrically operable valves V1 to V4 associated with the various hydraulic actuators of the apparatus, e.g. valve V1 may control the ram 18, valve V2 may control the ram 54, valve V3 may control the ram 58 and valve V4 may control the ram 66 according to the control data entered via the operator control 150.

The control circuitry will accordingly include a number of electrical proximity sensors or such like to enable the conditions of the various operating components to be monitored. For example, there will be sensor means associated with each of the following: the carriage 14 to enable the axial position of the die holder to be ascertained by the micro-processor at any instant; the plungers 52 and 64 and the arm 50. These sensors are designated S1 to S4 respectively in FIG. 2. The sensor S3 for the plunger 64 for example comprises an electrical sensor 154 to ascertain the axial position of the plunger 64 relative to the carriage 14. The sensor 154 senses the position of an element 152 secured to the plunger 64, shown in FIG. 3B. The type of sensor used for monitoring each of the components may be of conventional form. In order that the relative position of the tube end is known, the control circuitry is arranged to bring the die holder to predetermined axial datum position at the end of each cycle with for example the largest die located at the working position. This die then acts as a limiting stop and the operator inserts each tube as far as possible until further advance is prevented by the die.

The typical working cycle hereinbefore described entails the following operations:

1. The rams 82 are operated manually to retract the jaw 72.

2. The formed tube is removed and a fresh tube is inserted as described above.

3. The rams 82 are operated manually to extend the jaw 72 into tube-clamping position.

4. To begin the automatic cycle, the valve V1 advances the ram 18.

5. The sensor S1 senses completion of the working stroke of the carriage 14 and causes the valve V1 to retract the ram 18.

6. The sensor S1 senses completion of the retraction of the carriage 14 and causes the valve V2 to retract the ram 54.

7. The sensor S2 senses completion of the retraction of the plunger 52 and causes the valve V3 to retract the ram 58.

8. The sensor S4 senses completion of the retraction of the arm 50 and causes the valve V2 to advance the ram 54.

9. The sensor S2 senses completion of the advance of the plunger 52 and causes the valve V4 to retract the ram 66.

10. The sensor S3 senses completion of the retraction of the plunger 64 and causes the valve V3 to extend the ram 58.

11. The sensor S4 senses completion of the advance of the arm 50 and causes the valve V4 to advance the ram 66.

12. The sensor S3 senses completion of the advance of the plunger 64 and causes the valve V1 to advance the ram 18.

13. The group of operations 5 through 12 is repeated twice, to complete two more working strokes of the carriage 14.

14. The group of operations 5 through 11 is performed once more.

15. The sensor S3 senses completion of the advance of the plunger 64 and causes the valve V1 to advance the ram 18.

16. The sensor S1 senses the arrival of the carriage 14 at the datum position and terminates the automatic cycle.

From the foregoing, it will be seen that a push-pointing machine is provided which has facilities for rapid changeover of the forming dies and the clamping jaws, which has means for automatically controlling the die holder both rotationally and axially and which holds the die holder and also the dies rigidly and securely in each of the indexed positions so that no significant lateral deflection of the tube end occurs during the tube end forming operations.

Having now described the invention what I claim is:

1. A tube end forming apparatus comprising a clamping device for rigidly holding a tube against longitudinal movement, a rotary head mounting for reciprocation lengthwise of the longitudinal axis of the tube when held by the clamping device, the axis of rotation of the rotary head being offset relative to said longitudinal axis, the rotary head being provided with a plurality of die mounting openings spaced angularly about said rotation axis, means for indexing the rotary head about said rotation axis to bring respective ones of said openings into alignment with said longitudinal axis, means for reciprocating the rotary head whereby, in use, on one stroke of the head a die is forced over the end of a tube held by the clamping device, characterised in that the indexing means comprises an arm which is moveable angularly about the rotational axis of said head and is provided with a plunger engageable with a plurality of sockets, one at a time, provided in the rotary head and means for pivoting said arm to and fro through predetermined angular increments corresponding to the spacing between said sockets.

2. Apparatus as claimed in claim 1 characterised in that said arm pivoting means comprises a fluid powered piston and cylinder device connected to said arm and extendable and retractable in a plane substantially perpendicular to said rotational axis of the head, said piston and cylinder device being mounted on a carriage which also mounts said arm and said head and which is connected to said reciprocating means.

3. Apparatus as claimed in claim 1 or 2 characterised in that a second plunger is provided to engage with said sockets, the first mentioned plunger and said second plunger being operable alternately whereby the head is engaged by said second plunger while said arm is being pivoted with the first plunger out of engagement with said sockets.

4. Apparatus as claimed in any one of claims 1 to 3 characterised in that said arm is axially offset from said head and said plunger or plungers are axially displaceable between their socket engaging and disengaging positions.

5. Apparatus as claimed in claim 4 in which the or each plunger is operable by a fluid powered piston and cylinder device.

6. Apparatus as claimed in claim 1 characterised in that said clamping device is arranged to align the tube with the lowermost die position of the rotary head.

7. A tube end forming apparatus comprising a clamping device for rigidly holding a tube against longitudinal movement, a rotary head mounting for reciprocation lengthwise of the longitudinal axis of the tube when held by the clamping device, the axis of rotation of the rotary head being offset relative to said longitudinal axis, the rotary head being provided with a plurality of die mounting openings spaced angularly about said rotation axis, means for indexing the rotary head about said rotation axis to bring respective ones of said openings into alignment with said longitudinal axis, means for reciprocating the rotary head whereby, in use, on one stroke of the head a die is forced over the end of a tube held by the clamping device, characterised in that the clamping device comprises a pair of jaw blocks removably located within a housing, one of the jaw blocks being stationary and the other being slideable towards and away from said one block under the control of a fluid powered ram or rams so as to clamp or unclamp a tube therebetween, said jaws being connected at opposite axial ends thereof one to a stationary part of the housing and the other to a movable part and the housing being provided with an opening at one end through which the jaws are accessible, the jaw ends adjacent said openings being connected to said stationary part and said movable parts by respective connecting elements which are held in place solely by removable plates inserted into the housing at said one end thereof whereby removal of said plates allow said connecting elements to be removed at the jaws to be withdrawn endwise through said opening.

8. Apparatus as claimed in claim 7 characterised in that the opposite ends of the jaws are connected to said stationary part and movable part by connecting elements which prevent lateral movement of the jaws relative to the stationary and movable parts respectively but not axial movement, the latter being prevented by the connecting elements provided in the vicinity of said opening of the housing.

9. A tube end forming apparatus comprising a clamping device for rigidly holding a tube against longitudinal movement, a rotary head mounting for reciprocation lengthwise of the longitudinal axis of the tube when held by the clamping device, the axis of rotation of the rotary head being offset relative to said longitudinal axis, the rotary head being provided with a plurality of die mounting openings spaced angularly about said rotation axis, means for indexing the rotary head about said rotation axis to bring respective ones of said openings into alignment with said longitudinal axis, means for reciprocating the rotary head whereby, in use, on one stroke of the head a die is forced over the end of a tube held by the clamping device, characterised in that means is provided for automatically controlling the axial and rotational positioning of the rotary head, said control means including means for sensing the axial positions of the rotary head and being automatically operable to bring the rotary head into a predetermined intermediate axial datum position relative to the clamping device in preparation for each working cycle.

* * * * *